US006347451B1

(12) United States Patent
Bloecker et al.

(10) Patent No.: US 6,347,451 B1
(45) Date of Patent: Feb. 19, 2002

(54) PROCESS FOR MANUFACTURING BUILT-UP CAMSHAFTS

(75) Inventors: Henning Bloecker, Stelle; Klaus Brandes, Asendorf; Martin Kruessmann, Hamburg, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/236,538

(22) Filed: Jan. 25, 1999

(30) Foreign Application Priority Data

Jan. 23, 1998 (DE) ..... 198 02 484

(51) Int. Cl.[7] ..... B21D 53/84
(52) U.S. Cl. ..... 29/888.1; 29/464; 29/512
(58) Field of Search ..... 29/888.1, 444, 29/464, 507, 512, 514

(56) References Cited

U.S. PATENT DOCUMENTS

| | | | |
|---|---|---|---|
| 4,867,004 A | 9/1989 | Swars | 74/567 |
| 5,201,247 A | 4/1993 | Maus et al. | 74/567 |

FOREIGN PATENT DOCUMENTS

| | | |
|---|---|---|
| DE | 37 26 083 | 2/1988 |
| DE | 37 04 092 | 5/1988 |
| DE | 37 17 517 | 12/1988 |
| DE | 37 24 904 | 2/1989 |
| DE | 38 03 682 | 8/1989 |
| DE | 38 42 589 | 6/1990 |
| EP | 0 328 010 | 8/1989 |
| EP | 0 389 070 | 9/1990 |

*Primary Examiner*—S. Thomas Hughes
*Assistant Examiner*—Marc W Butler
(74) *Attorney, Agent, or Firm*—Crowell & Moring LLP

(57) ABSTRACT

A process for manufacturing a built-up camshaft by which the operational safety of the camshaft is ensured in a simple manner in any engine operation and the camshaft can arbitrarily be adapted to abutments which have different positions because of the individual engine construction. At least one cam is pushed onto a hollow shaft, after which the hollow shaft is expanded between the two faces of the cam which extend transversely with respect to the longitudinal course of the hollow shaft and at the respective bearing point by means of a highly pressurized pressure fluid. This fluid is delivered by a lance-shaped probe introduced into the hollow space of the shaft. On the one hand, a press fit occurs between the cam and the hollow shaft and, on the other hand, a bulging of the bearing point of the hollow shaft occurs which bridges the distance between the hollow shaft and the abutment. The hollow shaft is sealed off between the expanded points by a sealing arrangement on the probe with respect to the expanding internal high pressure.

6 Claims, 4 Drawing Sheets

PROCESS FOR MANUFACTURING BUILT-UP CAMSHAFTS

BACKGROUND AND SUMMARY OF THE INVENTION

This application claims the priority of German Application No. 198 02 484.3, filed Jan. 23, 1998, the disclosure of which is expressly incorporated by reference herein.

The invention relates to a process for manufacturing built-up camshafts and to a system for implementing this process.

In the case of conventionally built-up camshafts, the outside tube diameter, which depends on the dimensions of the bearing shells, must not fall below a defined measurement. This is so that the stiffness of the camshaft as a whole and the resistance to wear of the bearing points of the camshaft are ensured. Simultaneously, the outside tube diameter corresponds to the bore diameter of the cam which is pushed onto the hollow shaft. Since the cam has a predetermined defined course in the transverse direction with respect to the hollow shaft, in order to carry out the operation of the charge cycle valves corresponding to their function, the cam belt (thus the cam section which forms the so-called base circle of the cam) becomes thinner as the outside tube diameter of the hollow shaft becomes larger. If the cam belt now falls below a certain thickness, it is difficult to achieve a lasting joining of the cam on the hollow shaft when a press fit is reached between the hollow shaft and the cam. This is because the cam no longer has a sufficient stiffness for absorbing the joining tension.

For manufacturing the camshaft, a medium outside tube diameter must therefore be maintained, at which, on the one hand, the camshaft and the bearing point have a sufficient stiffness and the bearing point is provided with a sufficient resistance to wear and, on the other hand, the cam belt is still sufficiently strong in order to ensure the capacity of the cam to absorb the joining tension. However, for reasons of space, because of the specific construction of the engine, the engine abutment for the bearing points of the camshaft—the bearing shells—, is arranged in some engines in a position in which the camshaft is spaced at a distance from the engine at its bearing point. As indicated, for example, in European Patent Document EP 0 328 010 A1, in which the joining of the cams, by the way, takes place with the admission of internal high pressure by means of a lance introduced into the hollow shaft, the bridging of the distance is, as a rule, achieved by the fastening of bearing sleeves on the camshaft at the position of the bearing points. However, the bearing sleeves have the disadvantage that they represent a separate component and therefore require a separate manufacturing. In addition, they must be fine-machined in a manner which requires higher expenditures and considerably increases costs for obtaining a high-quality surface. Further, they must be non-rotatably mounted on the hollow shaft. On the other hand, the bearing sleeves must sometimes have very thin dimensions (approximately 1 mm), whereby a stability on the hollow shaft when loaded in the engine operation virtually becomes non-existent.

From German Patent Document DE 37 04 092 C1, a built-up camshaft is known. Here, a bearing point is shaped out of the hollow shaft by means of an expanding internal high pressure forming. In this process, the hollow shaft, together with the cams to be joined on it, is placed and positioned in a hollow receiving mold of an internal high pressure forming tool consisting of at least two female molds. Then, while the tool is closed and a fluidic high pressure is applied in the hollow shaft, this hollow shaft is expanded. Thus, the hollow shaft is pressed together with the cams at the point where they are located. Simultaneously, the bearing points are widened corresponding to the distance to the abutment to be bridged. In this case, the high-expenditure system is disadvantageous because a press must apply the complete locking pressure for the internal high pressure forming tool or for the projected surface of the workpiece. Furthermore, the hollow shaft material, during the internal-high-pressure-caused widening in the area of the inserted cams, flows in the direction of the joints between the tool and the cams. This causes corresponding accumulations of material in the hollow shaft on both sides of the faces of the cam in the transition area of the cam face to the hollow shaft which push radially to the outside. These accumulations cause tensile stress peaks in the cam which result in an increased wear of the cam track. In addition, as a result of the load cycle in the engine operation, a dynamic moment of force affects the accumulations in the radial and axial direction. This results in a loosening of the cam on the shaft. Overall, because of the above-mentioned problems, the known process and system for manufacturing a built-up camshaft is suitable for vehicle use only to a limited extent, if at all.

It is an object of the invention to provide a process and a system for manufacturing a built-up camshaft by which the operational safety of the camshaft is ensured in a simple manner in any engine operation, and the camshaft can arbitrarily be adapted to abutments which have different positions because of the individual engine construction.

According to the invention, this object is achieved by a process and system for manufacturing built-up camshafts, at least one cam being pushed onto a hollow shaft, after which the hollow shaft is expanded between the two faces of the cam which extend transversely with respect to the longitudinal course of the hollow shaft. At the respective bearing point, by means of a highly pressurized pressure fluid which is delivered by a lance-shaped probe introduced into the hollow shaft, such that, on the one hand, a press fit occurs between the cam and the hollow shaft and, on the other hand, a bulging of the bearing point of the hollow shaft occurs which bridges the distance between the hollow shaft and the abutment, the hollow shaft is sealed off between the expanded points by a sealing arrangement on the probe with respect to the expanding internal high pressure.

As a result of the invention, the outside hollow shaft diameter of the unformed output shaft can be selected largely independently of the bearing diameter. If the outside diameter of the hollow shaft is selected appropriately, it is dimensioned to be so large that the hollow shaft resists bending. This bending resistance is sufficient for any engine operating situation. It is also dimensioned to be so small that, because of a sufficient cam belt thickness, the cam still has enough stiffness that it can absorb the joining tensions during the internal high pressure admission to the hollow shaft, on the one hand, and, on the other hand, without suffering any damage in the engine operation at any load.

Because of the independence of the bearing diameter of the dimensions of the residual hollow output shaft which is adjustable as desired, because of a targeted expanding forming of the bearing point of the hollow shaft by means of internal high pressure generated by way of a lance-type probe placed in the hollow shaft, modern engines of almost any construction can be equipped with a single type of camshaft. In this case, only the bearing point must be formed differently. This can easily be achieved by the variability of the manufacturing by internal high pressure forming. Thus, the camshaft can be almost arbitrarily adapted in a simple fashion to the constructional constraints with respect to the abutment and can be designed in its dimensioning in an operationally safe manner without the requirement of accepting more or less useful compromise solutions as the result of the dependence on the construction of the bearing point. The now possible use of essentially the same camshafts for different engines largely simplifies the manufacturing of the camshafts, especially considering the previous multiplicity of versions of shaft dimensions that were used. This thus considerably reduces the equipment expenditures and costs. With respect to the use of bearing sleeves, the separate component of the bearing sleeve can be completely eliminated. This is because this bearing sleeve can virtually be shaped out of the hollow shaft. This saves additional costs and the expenditures for non-rotatably fastening this bearing sleeve on the hollow shaft. A fastening of this type is particularly difficult in that the manufacturing of separate components as a rule has tolerances which must be taken into account later during the joining. In this case, after concluding the grinding process of the cams and the bearing points, the wall thickness of the bearing sleeve, which is normally low, may be reduced to such an extent that a joining or fastening of the bearing sleeve on the hollow shaft in an operational manner cannot be made possible. Furthermore, because of the construction of the bearing point according to the invention, there is no danger of a detachment in the engine operation. As the result of the use of the lance-shaped probe for the joining of the cam as well as for the construction of the bearing point, by which shapings and expansions of the hollow shaft can be achieved in a targeted manner without any overall stress to the hollow shaft by means of internal high pressure, a die with the pertaining immense equipment expenditures can be eliminated. Only a clamping-in is required for the hollow shaft and the supporting tools for the cams and the bearing points. Because of the targeted use of the internal high pressure, in contrast to the use of a die, ejections of the hollow shaft, which form directly following the cams and which result in a loosening of the respective cam in the engine operation, can be avoided. This contributes considerably to the operational reliability of the camshaft in the engine operation.

Other objects, advantages and novel features of the present invention will become apparent from the following detailed description of the invention when considered in conjunction with the accompanying drawings.

DETAILED DESCRIPTION OF THE DRAWINGS

Figure 1:
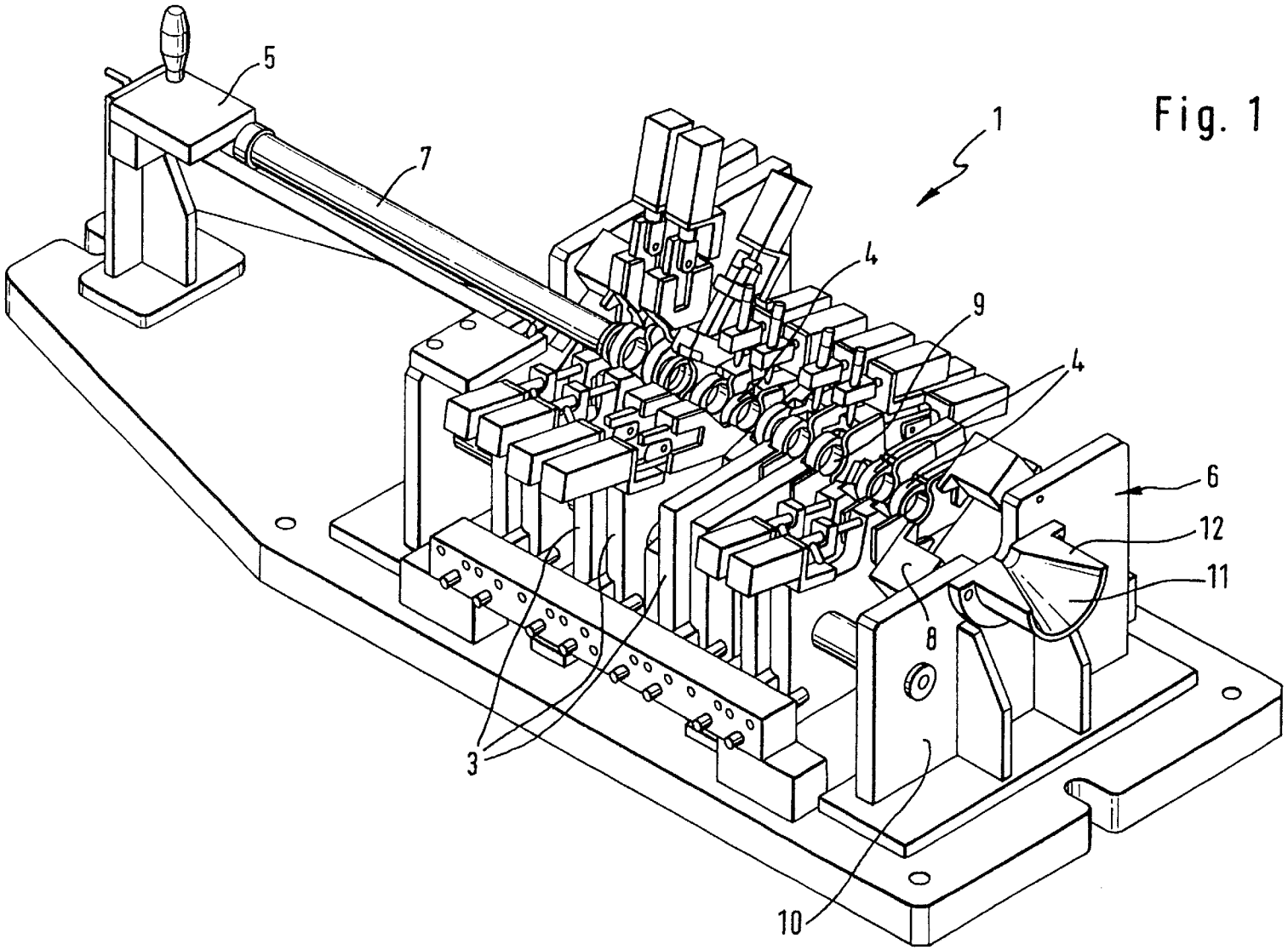
FIG. 1 is a perspective view of a system according to the invention for manufacturing built-up camshafts.
Figure 5:
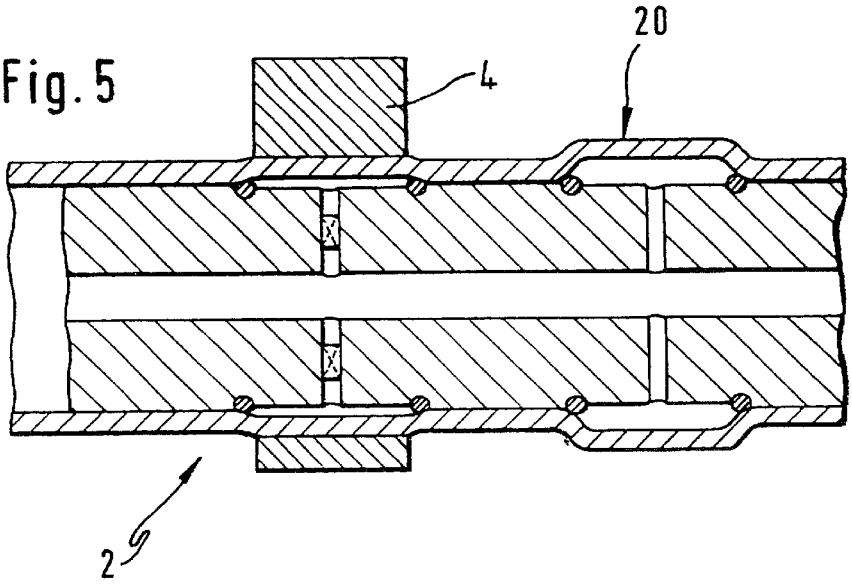
FIG. 5 is a lateral longitudinal sectional view of a final form of the camshaft constructed according to the invention with an inserted probe.
Figure 6:
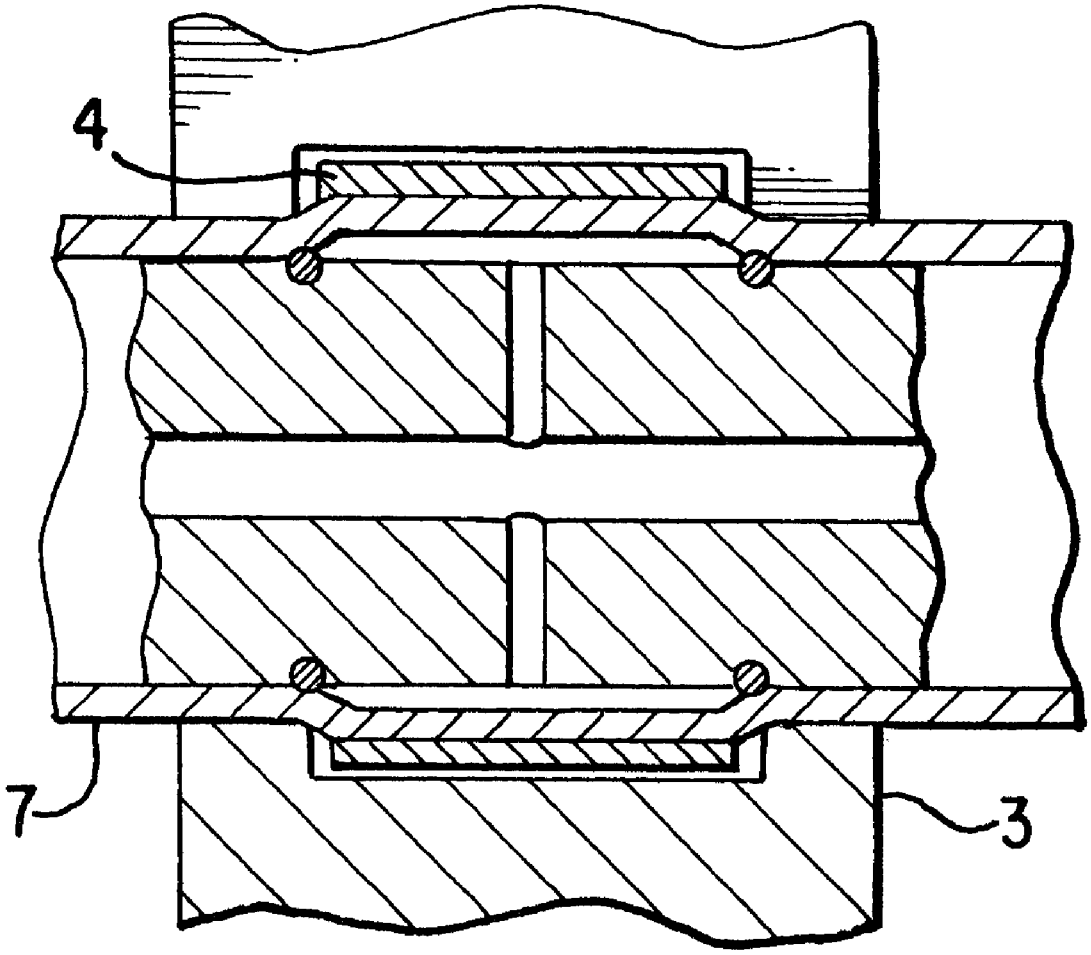
FIG. 6 is a lateral longitudinal sectional view of an expanded bearing point of the hollow shaft which has been expanded against a cam being positioned by a tool.

FIG. 1 illustrates a system 1 for manufacturing a built-up camshaft 2 (FIG. 5). The system 1 contains several tools 3 arranged one behind the other for positioning and holding the cams 4 which are pneumatically aligned in the tools 3. These tools 3 are situated between a hollow shaft feed 5 and a clamping tool 6. The clamping tool 6 fixes the hollow shaft 7 on one end by means of a gripper 8 in a centric position. Before the fixing, the hollow shaft 7 is threaded by the feed 5 through the cam bores 9 of the cams 4 held in the tools 3. On the side 10 of the clamping tool 6 facing away from the hollow shaft, a probe feeding device 12 is mounted. The probe feeding device 12 is provided with a feeding funnel 11, by which a lance-shaped probe 13 (FIG. 2) can be slid into the clamped-in hollow shaft 7 in a precisely centered manner.

Figure 2:
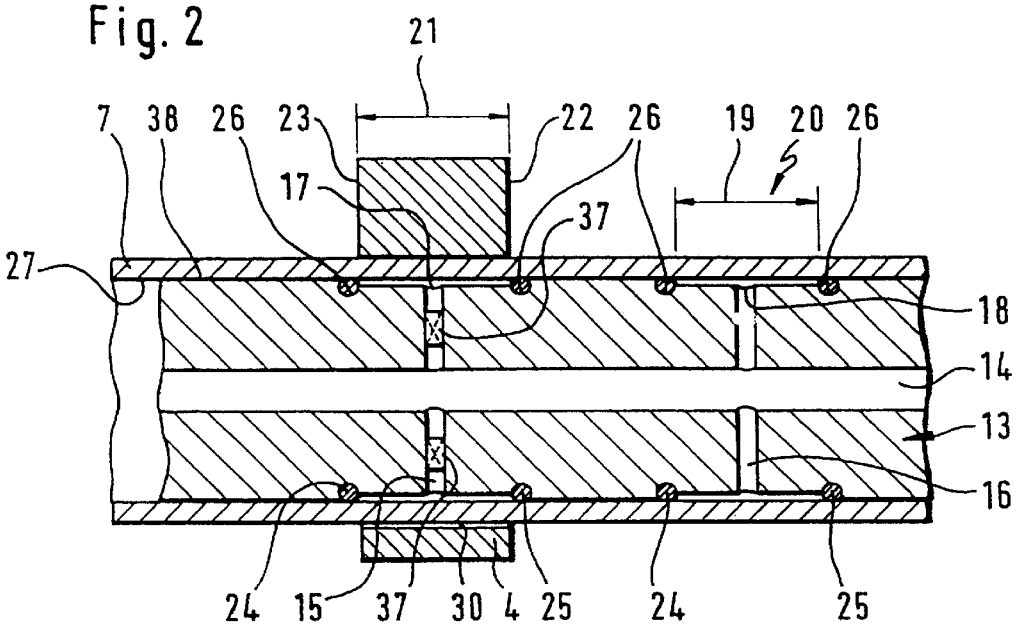
FIG. 2 is a lateral longitudinal sectional view of a hollow shaft in its initial form with a slid-on cam and an a probe introduced therein.

Referring to FIG. 2, the probe 13 essentially consists of a metal rod which has a central pressure fluid guiding duct 14 which is fluidically connected with a high pressure fluid generating system. Two mutually axially spaced transverse ducts 15 and 16 branch off the pressure fluid guiding duct 14 and have outlet openings 17 and 18 in the probe jacket 38. It is contemplated to machine into the probe jacket 38 a surrounding recess in the area of the outlet openings 17 and 18. This recess forms a ring-shaped pressure space which is open toward the hollow shaft 7. The result is a simultaneous and uniform admission of high pressure to the respective expansion point of the hollow shaft 7, whereby an equality of the contour of the expanded point of the hollow shaft 7 is achieved. This is advantageous for the required hold of the cam 4 to be applied on the camshaft 7 because of a press fit which is the same on all sides, and for the concentricity of the hollow shaft 7 in the bearing shells arranged on the engine in the engine operation. In the slide-in position of the probe 13, the outlet openings 17 and 18 are naturally placed in the area 19 of the bearing point 20 of the hollow shaft 7 to be expanded by fluid high pressure and on the section of the 21 of the hollow shaft 7 between the two faces 22, 23 of the respective cam 4 extending transversely to the longitudinal course of the hollow shaft 7.

The expansion area 19 and the section 21 are axially bounded on both sides by sealing body pairs in the form of two axially spaced ring seals 24, 25 which each form the sealing arrangement for the hollow shaft and which are carried by the probe 13 and, for whose holding, two surrounding receiving grooves 26 respectively are constructed in the probe jacket 38. The ring seals 24, 25 are sealingly radially supported on the interior side 27 of the hollow shaft 7. In addition to the sealing body pairs, the sealing arrangement for the bearing point 20 comprises a supporting tool 28 (FIGS. 3*a, b*) and 29 (FIGS. 4*a, b*) which, in the operative position, rests rigidly on the outside of the hollow shaft 7 in a surrounding manner. This leaves open the area 19 of the hollow shaft 7 which is to be expanded and covers the ring seals 24, 25. The supporting tool 28, 29 consists of three clamping-jaw-type segments 39, 40, 41, whose dividing joints 42 rest against the hollow shaft 7 and are arranged to be offset with respect to one another by approximately 120°.

Figure 3A:
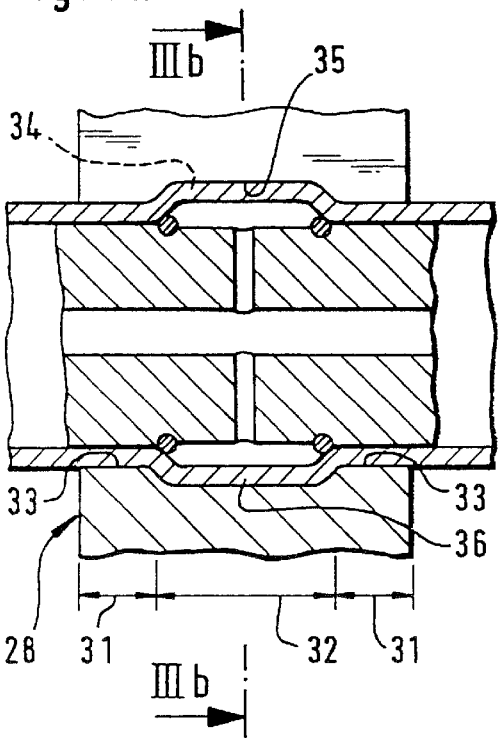
FIG. 3*a* is a lateral longitudinal sectional view of a bearing point of the hollow shaft from FIG. 2 in a calibrated form with a surrounding supporting tool.
Figure 3B:
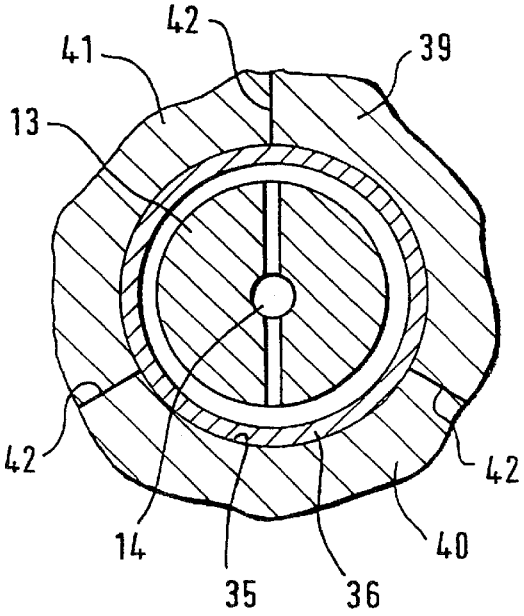
FIG. 3*b* is a sectional view of the hollow shaft from FIG. 3*a* taken along Line IIIb—IIIb.
Figure 4A:
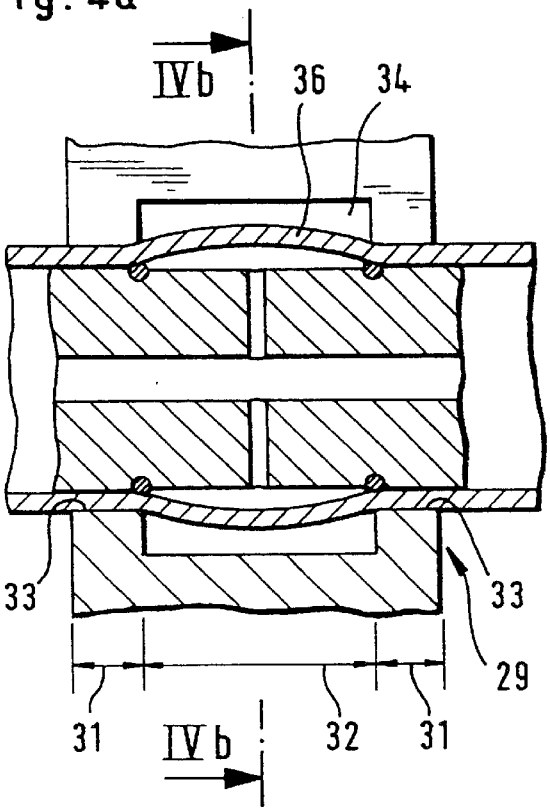
FIG. 4*a* is a lateral longitudinal sectional view of a bearing point of the hollow shaft of FIG. 2 in an expanded form of the bearing point with a surrounding supporting tool.
Figure 4B:
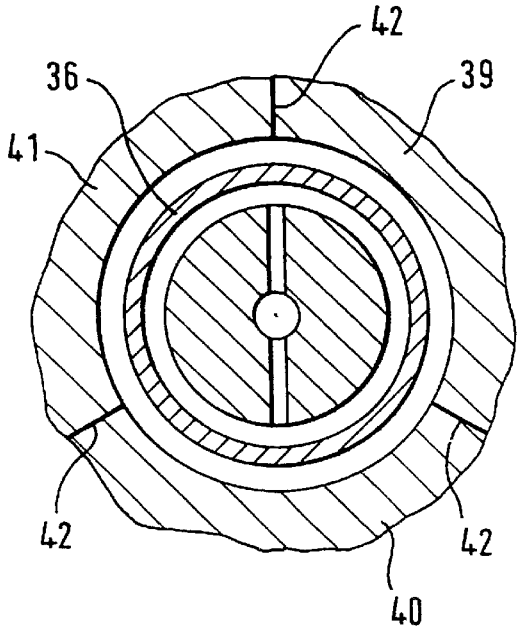
FIG. 4*b* is a sectional view of the hollow shaft from FIG. 4*a* taken along line IVb—IVb.

For manufacturing the built-up camshafts 2, the probe 13 is pushed into the hollow shaft 7. The probe 13 with the outlet openings 17, 18 of the transverse ducts 15, 16 of the pressure fluid guiding duct 14 is axially aligned exactly with the respective expansion area 19 and the section 21. Prior to that, as described above, the hollow shaft 7 can be threaded through the cam bores 9 of the cams 4. However, as an alternative, the cams 4 may be pushed onto a fixedly clamped-in hollow shaft 7 and may be positioned there in the provided relative position. The cams 4 are now positioned with some "play"—represented by the play gap 30 in FIG. 2—on the hollow shaft 7. Then the supporting tools 28, 29 are moved radially with respect to the hollow shaft 7 until they rest against this hollow shaft 7. The sections 31 of the supporting tool 28, 29 which rest against the hollow shaft 7 and directly adjoin the expansion area 19 of the hollow shaft 7 are connected with one another by a section 32 of the tool 28, 29 spanning the bearing point 20 to be expanded. With respect to the contact surfaces 33 of the tool 28, 29, the section 32 juts back so far that it encloses a ring-shaped expansion space 34 with the bearing point 20 (FIGS. 4*a, b*). The surface 35, which faces the bearing point 20, of the spanning section 32 of the tool 28 may be shapingly constructed in the manner of a die sinking for the bearing point 20 to be expanded and is then highly polished in order to ensure as good as possible material flow during the expansion (FIGS. 3*a, b*). Finally, by way of the pressure fluid guiding duct 14 and the transverse ducts 15 and 16 of the probe 13, a pressurized pressure fluid is applied to the hollow shaft 7. Because of the internal high pressure in the area 19 and the section 21, the shaft 7 expands radially to the outside, after which, on the one hand, the press fit is achieved between the cam 4 and the hollow shaft and, on the other hand, the bulging 36 of the bearing point 20 is achieved which bridges the distance between the hollow shaft 7 and the abutment of the engine. In the operative position, the supporting tool 28, 29 is rigidly, thus immovably, arranged. In the process, the tool covers the ring seals 24, 25 such that a lifting-off of the hollow shaft material resting against the ring seals 24, 25 from the ring seals 24, 25 is avoided while high pressure fluid is admitted, which would otherwise result in the loss of their sealing effect. Because of the expansion area narrowing to the section 21 between the faces 22, 23 of the respective cam 4 by means of the targeted placing of the ring seals 24, 25, material accumulations of the hollow shaft 7, which are harmful to a secure hold of the cam 4 on the hollow shaft 7, are prevented on both sides of the cam 4. As the result of the sealing effect, the sections of the hollow shaft 7 between the bearing points 20 and the sections 21 of the cams 4 remain without pressure and therefore unformed.

The expansion of section 21 and of area 19 of bearing point 20 may take place simultaneously. However, because of the faster contact of the cam 4 on the hollow shaft 7, in contrast to achieving the desired final shape of the bearing point 20 (due to the larger expansion), axial tensile stress acts upon the cam 4. This may lead to a reduction of the transmissible torques onto the cam 4 in the engine operation. Although this can be reduced in that, because of the support by the tool 28, 29, the hollow shaft 7 is clamped-in such that the hollow shaft material for expanding the bearing point 20 is not freely obtained from the length of the hollow shaft 7 but only from area 19 so that the wall thickness of the bearing point 20 is reduced in its final shape in comparison to its initial shape. However, the reduced wall thickness of the bearing point 20 is detrimental to its resistance to wear and to its stiffness. Furthermore, a free flow of the hollow shaft material from the length of the hollow shaft 7 has a negative effect on the positioning of the cams 4 on the hollow shaft 7 because the hollow shaft 7 is shortened after the forming so that a repositioning of the cams 4 is required or a high-expenditure leading of material is required. This results in a larger initial hollow shaft length. The latter is also accompanied by a high-expenditure prepositioning of the cams 4 which deviates from the end position.

As an alternative, the construction of the bearing point 20 and the joining operation of the cam 4 on the hollow shaft 7 can advantageously take place sequentially. The bearing point 20 is shaped out first. For this purpose, a pressure-limiting valve 37 is arranged in the transverse duct 15 to the cam 4. This pressure limiting valve 37 blocks the transverse duct 15 when the bearing point 20 is acted upon by internal high pressure. The respective cam 4 is pushed onto the hollow shaft 7 into a provisional joining position or takes up a provisional joining position when the hollow shaft 7 is threaded into the cams 4. Now, as desired, according to FIGS. 4*a, b*, the bearing point 20 is expanded in a simple manner in the form of a bulging 36 by approximately 1 to 2 mm. However, the abutment on the engine must correspondingly be constructed in a spherical shape, which is again accompanied by some expenditures.

If the surface 35 of the tool section 32 facing the bearing point 20 is constructed in the manner of a die sinking, the bearing point 20 may, however, assume a cylindrical shape during the expansion after the contact of the hollow shaft material on the die sinking, whereby the construction of the abutment of the engine is simplified (FIGS. 3*a, b*). Section 32 which simulates a die sinking may also be formed by a tool mold which is separate with respect to the supporting tool 28. In order to achieve a precise contouring of the bearing point 20, the bearing point 20 must be calibrated at a pressure which is considerably higher than the expansion pressure. After the forming of the bearing points 20, which are shaped freely out of the length of the hollow shaft and thus in the final shape have largely the same wall thickness as in the initial shape of the hollow shaft 7, (in which case the shortening of the hollow shaft 7 which occurs during the forming for maintaining the spacing of the bearing points 20 by leading material can be countered by using a larger hollow shaft 7 or by a successive expansion of the individual bearing points 20), the cams 4 are positioned between the bearing points 20 in their final joined shape. Then the transverse duct 15 is opened up and section 21 of the hollow shaft 7 is acted upon in a second forming operation by an internal high pressure which is significantly lower than the above-described expansion pressure for the bearing point 20, particularly the calibration pressure. By means of the above expansion of the hollow shaft 7, the cam 4 is joined to it while forming a press fit. During this second forming, the shortening of the hollow shaft 7 is not important because the hollow shaft 7 is expanded there by only approximately 0.2 mm. In order to avoid a further widening during the joining operation, when the supporting tool 29 is used, it is useful to provide a pressure limiting valve also in the transverse duct 16 which blocks the transverse duct during the above-mentioned joining. After the completion of the forming operations of the hollow shaft 7, the desired camshaft 2 is obtained, as illustrated in FIG. 5. The pressure fluid is relaxed; the supporting tools 28, 29 are removed; and the probe 13 is pulled out of the camshaft 2. Then the clamping is released and the finished camshaft 2 is removed for further building operations.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for manufacturing a built-up camshaft, the process comprising the acts of:

sliding at least one cam having two end faces onto a hollow shaft;

inserting a fluid pressure delivering probe into the hollow shaft;

sealing-off the hollow shaft via a sealing arrangement at a location between the two end faces of the cam and a respective bearing point on the hollow shaft;

exteriorly supporting the hollow shaft at the location of the sealing-off such that the hollow shaft is substantially prevented from lifting off from the sealing arrangement; and expanding the hollow shaft at a location between the two end faces of the cam and at the respective bearing point via high pressurized fluid from the probe, such that a press fit occurs between the cam and the hollow shaft and a bulging occurs at the bearing point of the hollow shaft, said bulging being dimensioned to bridge a distance between the hollow shaft and an abutment.

2. The process according to claim 1, wherein the act of sliding the cam further comprises an act of positioning the cam in a desired relative position on the hollow shaft corresponding to a final press fit position; and further wherein the expanding act simultaneously applies the high pressure fluid to a joining point of the hollow shaft with the cam between the two end faces and the respective bearing point.

3. The process according to claim 2, wherein an expansion of the respective bearing point takes place exclusively while reducing a wall thickness in an area of the hollow shaft which is expanded.

4. The process according to claim 1, wherein the sliding on of the cam further comprises further sliding the cam onto the hollow shaft into a provisional joining position;

expanding the respective bearing point of the hollow shaft;

placing the cam into a final joining position; and subsequently joining the cam to the hollow shaft via the expansion by the high pressure fluid.

5. The process according to claim 1, further comprising finally acting upon the expanded bearing point by a calibrating pressure significantly higher than an expansion pressure, wherein the respective bearing point is contoured by being pressed against a tool mold surrounding the respective bearing point.

6. The process according to claim 1, further comprising the act of applying different fluid pressures to a joining point of the cam and the respective bearing point, wherein the respective bearing point is acted upon by a higher pressure.

* * * * *